United States Patent [19]

Mitchell

[11] 4,280,745

[45] Jul. 28, 1981

[54] MERCHANDISING MACHINE SHELF SUPPORTING STRUCTURE

[75] Inventor: Robert P. Mitchell, Pequannock, N.J.

[73] Assignee: Rowe International, Inc., Whippany, N.J.

[21] Appl. No.: 90,502

[22] Filed: Nov. 1, 1979

[51] Int. Cl.[3] ..... A47B 88/06; A47B 96/16

[52] U.S. Cl. ..... 312/323; 221/75; 312/123; 312/234; 312/294; 312/333

[58] Field of Search ..... 312/35, 120, 123, 234, 312/294, 319, 323, 333, 348; 221/75, 85

[56] References Cited

U.S. PATENT DOCUMENTS

| | | | |
|---|---|---|---|
| 3,053,603 | 9/1962 | Schafiro et al. | 312/323 |
| 3,320,010 | 5/1967 | Ritzerfeld | 312/323 |
| 3,990,754 | 11/1976 | Pitel et al. | 312/35 |

*Primary Examiner*—Casmir A. Nunberg
*Attorney, Agent, or Firm*—Shenier & O'Connor

[57] ABSTRACT

A merchandising machine shelf supporting structure in which respective left and right hand cabinet panel supported lower guide rails receive rollers mounted at the rear of the shelf and in which left and right hand shelf supported upper guide rails receive cabinet panel carried rollers mounted adjacent to the front of the cabinet. As the shelf is moved manually from a housed or home position at which shelf carried plugs engage cabinet carried sockets the rollers and rails support the cabinet so that the force required to withdraw the shelf is relatively low. As the shelf approaches its intermediate position at which the shelf is to be loaded, pins on the shelf engage stops at the front ends of the lower guide rails and the shelf is permitted to pivot to a position at which the shelf rollers are received in recesses formed by elements secured to lower guide rails. After loading the shelf may easily be returned to its home position. As it approaches its home position detenting portions of the upper guide rails act on the upper rollers to ensure that the shelf moves fully into its home position in which the shelf carried plugs engage in the cabinet carried sockets. The lower rail upper retainer flange terminates at a location to the rear of the rail stop to permit the shelf carried stop pins to be lifted over the stop and then to permit the shelf rollers to be moved upwardly to the openings between the stops and the terminal of the lower guide rail upper flange for complete removal of the shelf from the machine.

14 Claims, 5 Drawing Figures

MERCHANDISING MACHINE SHELF SUPPORTING STRUCTURE

BACKGROUND OF THE INVENTION

One common type of merchandising machine known in the prior art incorporates a plurality of shelves each of which supports a number of merchandise delivery units adapted to be individually activated to deliver an article from the supply to a customer. In many of these merchandising machines the delivery members are helical members which receive articles to be dispensed between adjacent turns and which are rotated to cause an article to fall over the front edge of the shelf down to a delivery box from which the customer extracts the article. In most of the merchandising machines of this type each shelf is supported for movement in the merchandising machine cabinet from a housed position, at which electrical connectors at the rear of each of the units are engaged to complete the circuits of the delivery member drive motors to an intermediate position at which with the cabinet door open the shelf is partially withdrawn from the cabinet and swung around a transverse axis to a loading position at which the shelf is inclined and at which the interturn spaces of the product delivery member are exposed to permit loading of the unit. Further, most of the machines of this type are so arranged so that each shelf can manually be completely removed from the cabinet for servicing and the like. Structurally, most of the machines of this type involve rollers and rails carried respectively by the shelf and by the cabinet walls to permit movement of the shelf relative to the cabinet.

While a number of the arrangements of the prior art successfully achieve the results of permitting movement of the shelf from a housed position to a loading position and permitting manual removal of a shelf from the machine, they incorporate a number of disadvantages. First, owing to their particular construction, arrangements of the prior art require a relatively high force to move the shelf relative to the cabinet. Secondly, assemblies of the prior art are not as reliable as is desirable in ensuring effective contact between the plugs on the shelves and the sockets in the cabinets as a shelf is moved into its home position. Further, the operation of manually completely removing the shelf from the cabinet in arrangements of the prior art is not as easy as is desirable.

SUMMARY OF THE INVENTION

One object of my invention is to provide a merchandising machine shelf supporting structure and more particularly to such a structure which requires only a relatively low force to move the shelf over its entire range of movement from a position to which it is entirely housed to an intermediate loading position and finally to a position at which it is completely removed from the housing.

Another object of my invention is to provide a merchandising machine shelf supporting structure provided with means with which ensures reliable engagement between the shelf plugs and the cabinet sockets when the shelf moves to its home position.

Another object of my invention is to provide a merchandising machine shelf supporting structure which greatly facilitates the operations of manually removing a shelf from a cabinet and then replacing the shelf.

Other and further objects of my invention will appear from the following description.

In general my invention contemplates the provision of a merchandising machine shelf supporting structure in which respective left and right hand cabinet panel supported lower guide rails receive rollers mounted at the rear of the shelf and in which left and right hand shelf supported upper guide rails receive cabinet panel carried rollers mounted adjacent to the front of the cabinet. As the shelf is moved manually from a housed or home position at which shelf carried plugs engage cabinet carried sockets the rollers and rails support the cabinet so that the force required to withdraw the shelf is relatively low. As the shelf approaches its intermediate position at which the shelf is to be loaded, pins on the shelf engage stops at the front ends of the lower guide rails and the shelf is permitted to pivot to a position at which the shelf rollers are received in recesses formed by elements secured to lower guide rails. After loading the shelf may easily be returned to its home position. As it approaches its home position detenting portions of the upper guide rails act on the upper rollers to ensure that the shelf moves fully into its home position in which the shelf carried plugs engage in the cabinet carried sockets. The lower rail upper retainer flange terminates at a location to the rear of the rail stop to permit the shelf carried stop pins to be lifted over the stop and then to permit the shelf rollers to be moved upwardly to the openings between the stops and the terminal of the lower guide rail upper flange for complete removal of the shelf from the machine.

BRIEF DESCRIPTION OF THE DRAWINGS

In the accompanying drawings which form part of the instant specification and which are to be read in conjunction therewith and in which like reference characters are used to indicate like parts in the various views:

FIG. 3 is a side elevation of the shelf and supporting structure illustrated in FIG. 2 with parts broken away and with other parts shown in section illustrating the home position of the shelf.

DESCRIPTION OF THE PREFERRED EMBODIMENT

Figure 2:
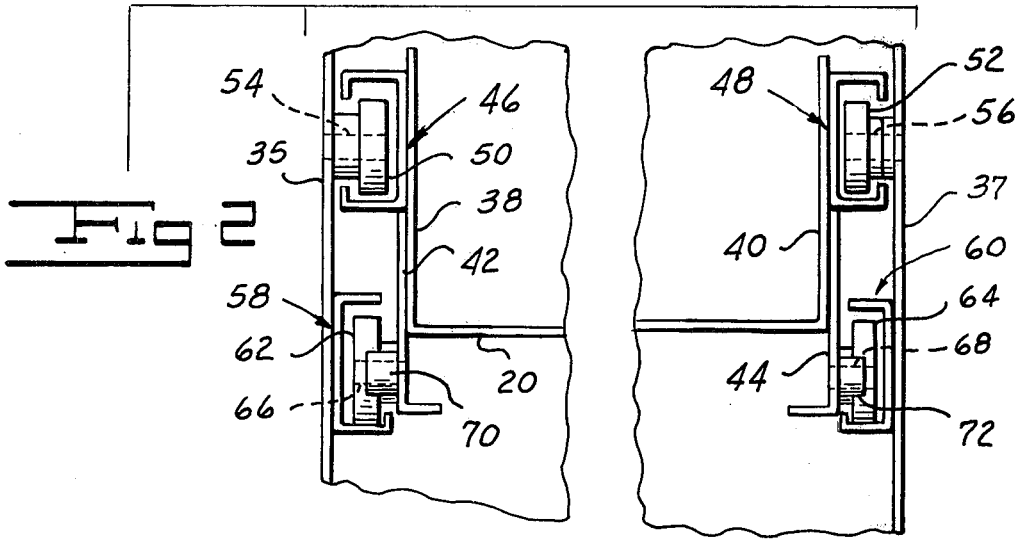
FIG. 2 is a fragmentary front elevation of one of the shelves of the machine shown in FIG. 1 which is provided with my merchandising machine shelf supporting structure.
Figure 1:
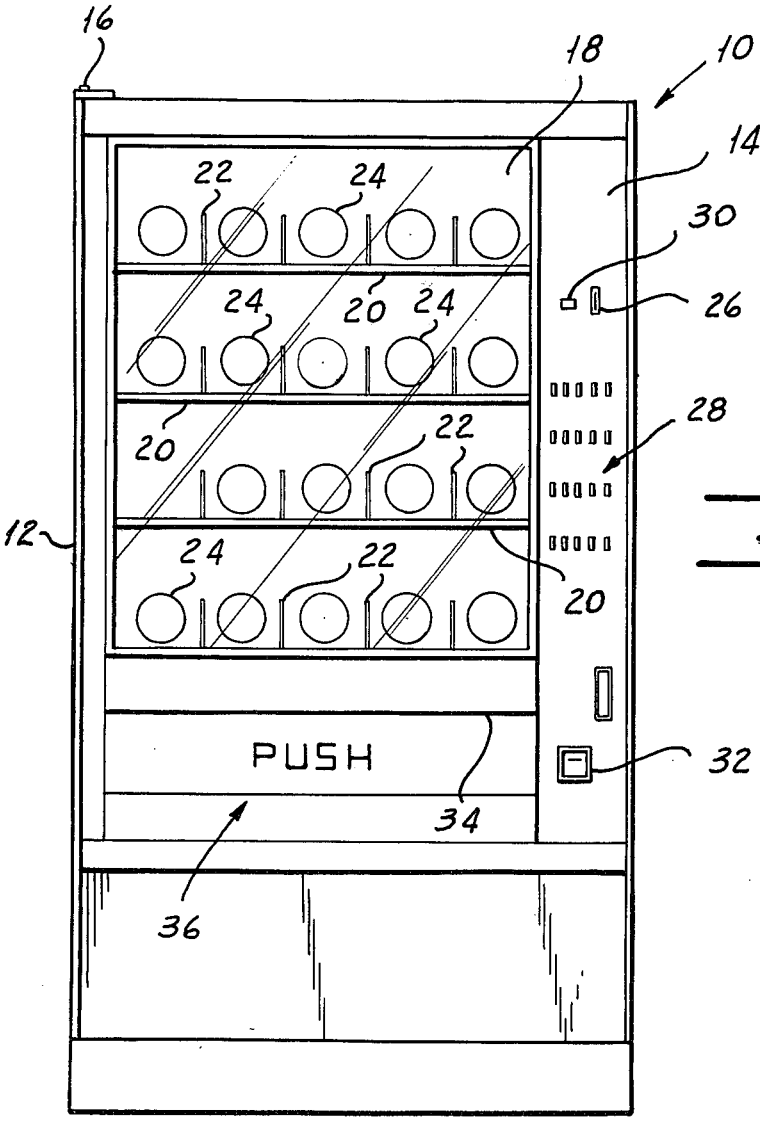
FIG. 1 is a front elevation of one form of merchandising machine which may be provided with my merchandising machine shelf supporting structure.

Referring now to the drawings, a machine indicated generally by the reference character 10 which may be provided with my merchandising machine shelf supporting structure includes a cabinet 12 having a door 14 secured to the cabinet by a hinge 16. Door 14 is provided with a window 18 through which articles of merchandise to be delivered can be viewed by a prospective customer.

Machine 10 includes a number of shelves 20 carrying partitions 22 between each pair of which a delivery member 24 which may, for example, be a helical member adapted to receive articles between the turns thereof is mounted. As is known in the art in response to a deposit in a coin slot 26 of a sum in coins aggregating the purchase price of an article and the actuation of a pushbutton 28 corresponding to the selected article, the associated member 24 will be rotated by a motor (not shown) or the like to cause the article to be delivered to a tray or the like (not shown) behind an opening 34 normally closed by a door 36. If desired the customer may actuate a member 30 to have his money returned through a coin return opening 32 in the event he changes his mind before a purchase is made.

The machine 10 houses a pair of left and right shelf supporting panels 35 and 37. Each of the shelf units includes left and right side walls 38 and 40 carrying respective roller mounting plates 42 and 44 as well as respective left and right hand upper guide rails indicated generally by the respective reference characters 46 and 48. Panels 35 and 37 carry respective left and right upper rollers 50 and 52 mounted on shafts 54 and 56 adjacent to the front of the machine 10. Rollers 50 and 52 are adapted to cooperate with the guide rails 46 and 48 in a manner to be described more fully hereinbelow.

Panels 35 and 37 support respective lower guide rails indicated generally by reference characters 58 and 60 secured to the panels by any suitable means such, for example, by welding or the like. Plates 42 and 44 carry respective lower guide rollers 62 and 64 supported on shafts 66 and 68 adjacent to the rear of the shelf assembly. Plates 42 and 44 further carry respective stop pins 70 and 72 the function of which will be described more fully hereinbelow. Rollers 62 and 64 are adapted to be received in the lower guide rails 58 and 60. Each dispensing unit carried by a shelf 20 incorporates a drive motor (not shown) or the like adapted to be supplied with electrical energy by means of a plug 74 carried by a bracket 76 secured to the shelf 20. In the home position of a shelf 20 the plugs 74 of all of the units thereof are adapted to mate with receptacles 78 carried by a panel 80 at the rear of the merchandising machine 10.

Since the left hand and right hand shelf supporting assemblies are substantially the same only the right hand assembly will be described in detail.

The upper right hand guide rail 48 includes a top wall 82 which rests on the roller 52 during most of the movement of the shelf 20 relative to the machine cabinet 12.

I form the rearward portion of the top wall 82 with ramp 84 leading to a top wall portion 85 the underside of which is engaged by the roller 52 in the loading position of the shelf to be described hereinbelow. I further form the wall 82 with a retainer flange 86 located inboard of the roller 52. A detent portion 88 on the upper wall 82 ensures that the shelf moves to its fully home position wherein plug 74 is engaged in receptacle 78 as the shelf moves into the cabinet. This upper guide rail also includes a bottom wall 90, the rear end of which is provided with an inlet guide 92 and the forward edge of which is provided with a lower retaining flange 94.

The lower right hand guide rail 60 includes a top wall 96 and a bottom wall 98. An element 100 secured to the lower rail 60 by any suitable means such, for example, as by welding or the like, forms a recess extending above an opening in the wall 96 to receive the roller 64 in the loading position to be described. A stop 102 secured to the forward edge of the guide rail 60 is adapted to be engaged by a pin 72 when the shelf is to move to loading position. I cut away the portion of the upper wall 96 adjacent to the front of the guide rail 60 to form an opening 104 through which first pin 72 and then roller 64 is adapted to be moved in the course of removal of a shelf from the machine. As has been pointed out hereinabove, it will readily be appreciated that the left hand upper guide rail 46 and the left hand lower guide rail 58 have all of the features just described in connection with the right hand upper guide rail 48 and the right hand lower guide rail 60.

In operation of my merchandising machine shelf supporting structure in the home position of a shelf illustrated in FIG. 3, roller 52 is in the detent portion 88 of the upper wall 82 of the upper guide rail 48. This ensures that plugs 74 are fully engaged with receptacles 78. When it is desired to move the shelf 20 to loading position the operator raises the front of a shelf slightly and pulls it forward to move the roller 52 out of the detent portion 88 of the upper wall 82 and draws the shelf forwardly. As this is done plugs 74 are disengaged from receptacles 78. In the course of this operation the shelf pivots slightly around rear rollers 62 and 64 and moves forwardly in a slightly inclined position. In the course of this movement walls 82 of rails 46 and 48 ride on rollers 50 and 52 and rollers 62 and 64 ride on the walls 98 of guide rails 58 and 60. Owing to the wide wheel base between the shelf rollers and the panel supported rollers the shelf can be withdrawn from the cabinet with relative ease.

Figure 4:
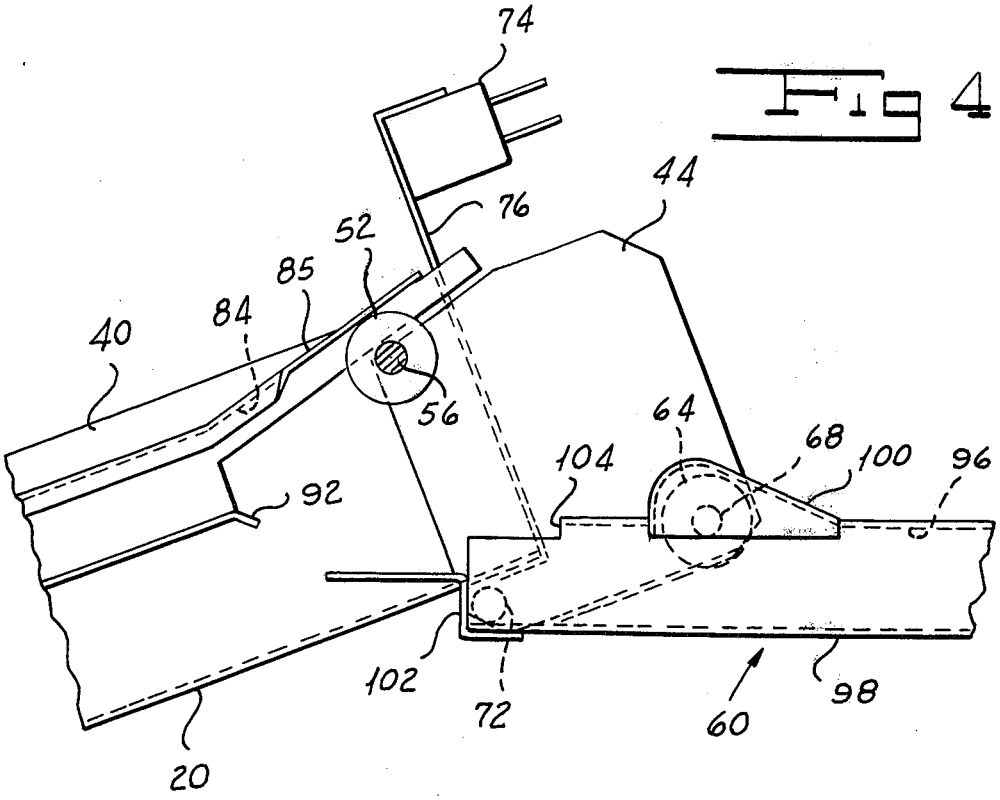
FIG. 4 is a fragmentary side elevation of my merchandising machine shelf supporting structure illustrating the loading position of the shelf.
Figure 5:
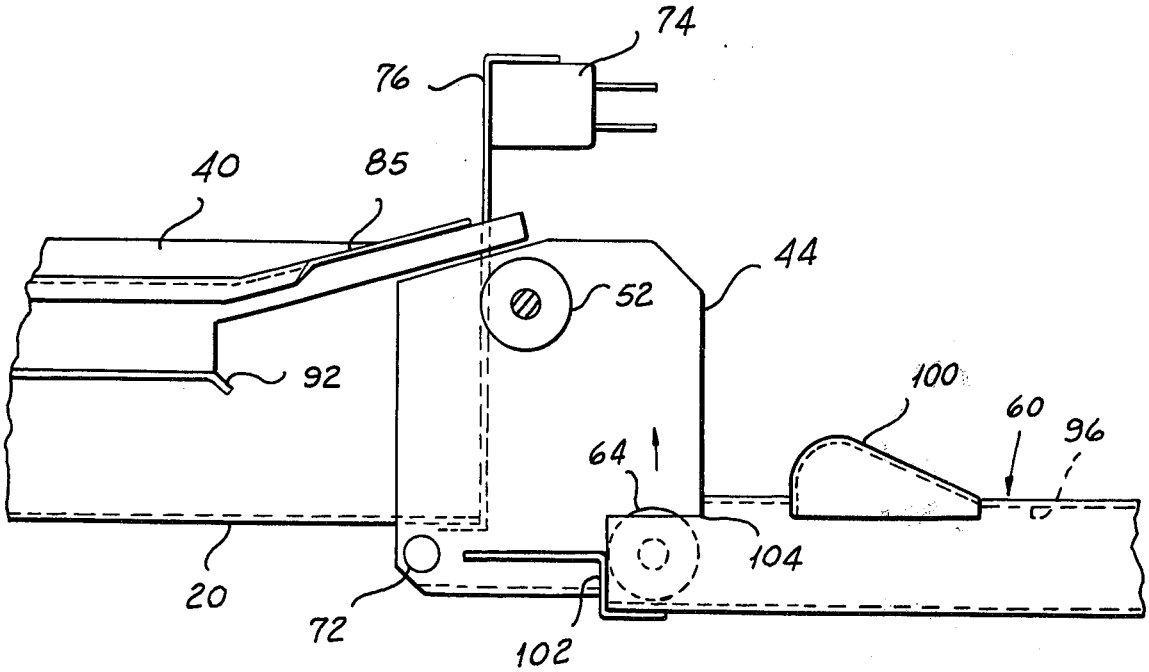

As the pins 70 and 72 approach the stops 102 ramps 84 engage rollers 50 and 52 to permit the shelf to pivot back to a generally horizontal position. Ultimately as illustrated in FIG. 4 pins 70 and 72 engage stops 102 and the shelf pivots around the common axis of the pins 70 and 72 until the rollers 62 and 64 move into the recesses formed by the elements 100. Rollers 50 and 52 engage the undersides of wall portions 85 in this position of the parts.

In the position of the parts shown in FIG. 4, all of the units of a shelf are accessable to the service man to enable him to load the unit. When the loading operation is complete the shelf is swung upwardly and then moved rearwardly towards its home position. Ramp 84 and guide 92 assist in ensuring that the rollers 50 and 52 enter into the space between the upper and lower walls of the guides 46 and 48. As the shelf arrives at its home position the rollers 50 and 52 ride into the detent portions 88 of the upper walls 82 of their guides 46 and 48 to ensure that plugs 74 are fully engaged with receptacles 78.

Figure 5:
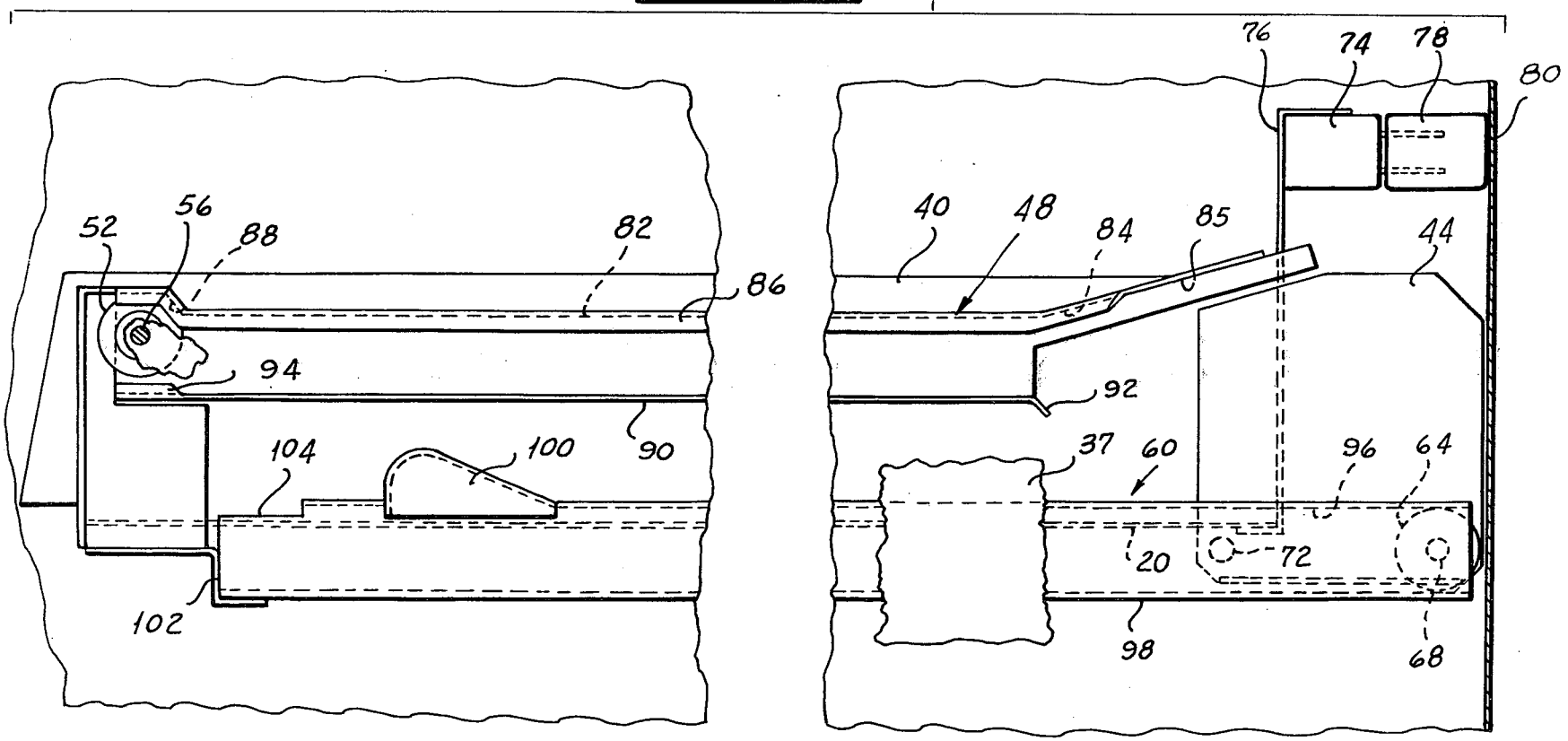
FIG. 5 is a fragmentary side elevation of my merchandising machine shelf supporting structure illustrating the relative position of the parts at just prior to complete removal of the shelf from the cabinet.

When it is desired to remove a shelf completely from the cabinet 12 the shelf is withdrawn in the manner described hereinabove. When pins 70 and 72 strike stops 102, however, instead of permitting the shelf to assume the loading position, the front edge is raised slightly to pivot the shelf around the axes of rollers 62 and 64 to move pins 70 and 72 above stops 102. The shelf is then moved further forwardly to the position shown in FIG. 5 until the rollers 62 and 64 engage stops 102. In this position of the parts, the shelf is relatively easily removed from the machine by lifting the rear of the shelf in the direction of the arrows shown in FIG. 5 to move rollers 62 and 64 upwardly through openings 104. Replacement of a shelf in the machine is readily achieved merely by reversing the operation just described.

It will be seen that I have accomplished the objects of my invention. I have provided a merchandising machine shelf mounting structure which requires only a relatively low force to move the shelf over its entire range of movement relative to the cabinet. My merchandising machine shelf supporting structure is provided with means for ensuring that the shelf moves fully into its home position so that the inter-engageable electrical elements carried by the shelf and by the cabinet are fully engaged. My merchandising machine shelf supporting structure allows for extremely easy and expeditious shelf removal and replacement.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a merchandising machine having a cabinet and a shelf, apparatus for supporting said shelf for movement relative to said cabinet including in combination, a lower guide rail having a bottom wall, means mounting said lower guide rail on said cabinet with the length thereof extending generally fore-and-aft of said cabinet, an upper guide rail having a top wall, means mounting said upper guide rail on said shelf with the length thereof extending in a direction from front to back of said cabinet, a rear shelf support roller, means mounting said rear support roller on said shelf adjacent to the rear thereof at a location at which it is received by the bottom wall of the lower guide rail, a front shelf supporting roller, means mounting said front shelf supporting roller on said cabinet adjacent to the front thereof at a location at which it may receive the top wall of said upper guide, a stop pin on said shelf at a location spaced forwardly of said rear roller, a stop at the front of said lower rail adapted to be engaged by said pin and means forming a recess above said lower rail at a location spaced rearwardly of said front by a distance corresponding to the spacing between said pin and said rear roller, said upper rail top wall being formed with an offset portion at the front of said rail for receiving said front roller as said shelf moves into its home position to ensure that said shelf moves fully into its home position, said upper rail top wall being formed with an upwardly extending ramp engaged by said front roller as said pin approaches said stop, said top wall terminating adjacent to the end of said ramp to permit the front roller to extend above the top wall in the loading position of said shelf.

2. In a merchandising machine having a cabinet and a shelf, apparatus for supporting said shelf for movement relative to said cabinet including in combination, a lower guide rail having a bottom wall, means mounting said lower guide rail on said cabinet with the length thereof extending generally fore-and-aft of said cabinet, an upper guide rail having a top wall, means mounting said upper guide rail on said shelf with the length thereof extending in a direction from front to back of said cabinet, a rear shelf support roller, means mounting said rear support roller on said shelf adjacent to the rear thereof at a location at which it is received by the bottom wall of the lower guide rail, a front shelf supporting roller, means mounting said front shelf supporting roller on said cabinet adjacent to the front thereof at a location at which it may receive the top wall of said upper guide, a stop pin on said shelf at a location spaced forwardly of said rear roller, a stop at the front of said lower rail adapted to be engaged by said pin, means forming a recess above said lower rail at a location spaced rearwardly of said front by a distance corresponding to the spacing between said pin and said rear roller, means forming an opening in the top of said lower guide rail behind said stop, said opening being of a sufficient size to permit movement of said pin and of said rear roller therethrough.

3. In a merchandising machine having a cabinet and a shelf, apparatus for supporting said shelf for movement relative to said cabinet including in combination, a lower guide rail having a bottom wall, means mounting said lower guide rail on said cabinet with the length thereof extending generally fore-and-aft of said cabinet, an upper guide rail having a top wall, means mounting said upper guide rail on said shelf with the length thereof extending in a direction from front to back of said cabinet, a rear shelf support roller, means mounting said rear support roller on said shelf adjacent to the rear thereof at a location at which it is received by the bottom wall of the lower guide rail, a front shelf supporting roller, means mounting said front shelf supporting roller on said cabinet adjacent to the front thereof at a location at which it may receive the top wall of said upper guide, a stop pin on said shelf at a location spaced forwardly of said rear roller, a stop at the front of said lower rail adapted to be engaged by said pin, means forming a recess above said lower rail at a location spaced rearwardly of said front by a distance corresponding to the spacing between said pin and said rear roller, said upper rail top wall being formed with an offset portion at the front of said rail for receiving said front roller as said shelf moves into its home position to ensure that said shelf moves fully into its home position.

4. In a merchandising machine having a cabinet and a shelf, apparatus for supporting said shelf for movement relative to said cabinet including in combination, a lower guide rail having a bottom wall, means mounting said lower guide rail on said cabinet with the length thereof extending generally fore-and-aft of said cabinet, an upper guide rail having a top wall, means mounting said upper guide rail on said shelf with the length thereof extending in a direction from front to back of said cabinet, a rear shelf support roller, means mounting said rear support roller on said shelf adjacent to the rear thereof at a location at which it is received by the bottom wall of the lower guide rail, a front shelf supporting roller, means mounting said front shelf supporting roller on said cabinet adjacent to the front thereof at a location at which it may receive the top wall of said upper guide, a stop pin on said shelf at a location spaced forwardly of said rear roller, a stop at the front of said lower rail adapted to be engaged by said pin and means forming a recess above said lower rail at a location spaced rearwardly of said front by a distance corresponding to the spacing between said pin and said rear roller.

5. In a merchandising machine having a cabinet and a shelf, apparatus for supporting said shelf for movement relative to said cabinet including in combination, a lower guide rail having a bottom wall, means mounting said lower guide rail on said cabinet with the length thereof extending generally fore-and-aft of said cabinet, an upper guide rail having a top wall, means mounting said upper guide rail on said shelf with the length thereof extending in a direction from front to back of said cabinet, a rear shelf support roller, means mounting said rear support roller on said shelf adjacent to the rear thereof at a location at which it is received by the bottom wall of the lower guide rail, a front shelf supporting roller, means mounting said front shelf supporting roller on said cabinet adjacent to the front thereof at a location at which it may receive the top wall of said upper guide, said upper rail top wall being formed with an offset portion at the front of said rail for receiving said front roller as said shelf moves into its home position to ensure that said shelf moves fully into its home position.

6. In a merchandising machine having a cabinet and a shelf, apparatus for supporting said shelf for movement relative to said cabinet including in combination, a lower guide rail having a bottom wall, means mounting said lower guide rail on said cabinet with the length thereof extending generally fore-and-aft of said cabinet, an upper guide rail having a top wall, means mounting said upper guide rail on said shelf with the length thereof extending in a direction from front to back of said cabinet, a rear shelf support roller, means mounting said rear support roller on said shelf adjacent to the rear thereof at a location at which it is received by the bottom wall of the lower guide rail, a front shelf supporting roller and means mounting said front shelf supporting roller on said cabinet adjacent to the front thereof at a location at which it may receive the top wall of said upper guide.

7. In a merchandising machine having a cabinet and a shelf, apparatus for supporting said shelf for movement relative to said cabinet including in combination, a lower guide rail having a bottom wall, means mounting said lower guide rail on one of said shelf and said cabinet with the length thereof extending generally fore-and-aft of said cabinet, an upper guide rail having a top wall, means mounting said upper guide rail on the other of said shelf and said cabinet with the length thereof extending in a direction from front to back of said cabinet, a rear shelf support roller, means mounting said rear support roller on said shelf adjacent to the rear thereof at a location at which it cooperates with one of said top and bottom walls, a front shelf supporting roller and means mounting said front shelf supporting roller on said cabinet adjacent to the front thereof at a location at which it cooperates with one of said top and bottom walls.

8. In a merchandising machine having a cabinet and a shelf, apparatus for supporting said shelf for movement relative to said cabinet including in combination, a lower guide rail, means mounting said lower guide rail on one of said cabinet and said shelf, an upper guide rail, means mounting said upper guide rail on the other of said cabinet and said shelf for movement therewith and at a location above the lower guide rail, a front guide roller, means mounting said front guide roller on said cabinet at a location adjacent to the front thereof for cooperation with one of said guide rails, a rear guide roller, means mounting said rear guide roller on said shelf adjacent to the back thereof for cooperation with the other of said guide rails, whereby said rollers and said rails support said shelf for movement from a fully housed home position in said cabinet to a position out of said cabinet, means responsive to movement of said shelf out of said cabinet to a first predetermined position for permitting limited pivotal movement of said shelf to a loading position, means responsive to a second predetermined position beyond said first position for permitting manual removal of said shelf from said cabinet, and means responsive to movement of said shelf from a position out of said home position to a position adjacent to said home position for ensuring that said shelf moves fully into said home position.

9. In a merchandising machine having a cabinet and a shelf, apparatus for supporting said shelf for movement relative to said cabinet including in combination, a lower guide rail, means mounting said lower guide rail on one of said cabinet and said shelf, an upper guide rail, means mounting said upper guide rail on the other of said cabinet and said shelf for movement therewith and at a location above the lower guide rail, a front guide roller, means mounting said front guide roller on said cabinet at a location adjacent to the front thereof for cooperation with one of said guide rails, a rear guide roller, means mounting said rear guide roller on said shelf adjacent to the back thereof for cooperation with the other of said guide rails, whereby said rollers and said rails support said shelf for movement from a fully housed home position in said cabinet to a position out of said cabinet, means responsive to movement of said shelf toward said home position for ensuring that said shelf moves fully into said home position.

10. In a merchandising machine having a cabinet and a shelf, apparatus for supporting said shelf for movement relative to said cabinet including in combination, a lower guide rail, means mounting said lower guide rail on one of said cabinet and said shelf, an upper guide rail, means mounting said upper guide rail on the other of said cabinet and said shelf for movement therewith and at a location above the lower guide rail, a front guide roller, means mounting said front guide roller on said cabinet at a location adjacent to the front thereof for cooperation with one of said guide rails, a rear guide roller, means mounting said rear guide roller on said shelf adjacent to the back thereof for cooperation with the other of said guide rails, whereby said rollers and said rails support said shelf for movement from a fully housed home position in said cabinet to a position out of said cabinet, means responsive to movement of said shelf out of said cabinet to a first predetermined position for permitting limited pivotal movement of said shelf to a loading position and means responsive to movement of said shelf out of said cabinet to a second predetermined position beyond said first predetermined position for permitting manual removal of said shelf from said cabinet.

11. In a merchandising machine having a cabinet and a shelf, apparatus for supporting said shelf for movement relative to said cabinet including in combination, a lower guide rail, means mounting said lower guide rail on one of said cabinet and said shelf, an upper guide rail, means mounting said upper guide rail on the other of said cabinet and said shelf for movement therewith and at a location above the lower guide rail, a front guide roller, means mounting said front guide roller on said cabinet at a location adjacent to the front thereof for cooperation with one of said guide rails, a rear guide roller, means mounting said rear guide roller on said shelf adjacent to the back thereof for cooperation with the other of said guide rails, whereby said rollers and said rails support said shelf for movement from a fully housed home position in said cabinet to a position out of said cabinet, means responsive to movement of said shelf to a position substantially out of said cabinet for permitting manual removal of said shelf from said supporting means.

12. In a merchandising machine having a cabinet and a shelf, apparatus for supporting said shelf for movement relative to said cabinet including in combination, a lower guide rail, means mounting said lower guide rail on one of said cabinet and said shelf, an upper guide rail, means mounting said upper guide rail on the other of said cabinet and said shelf for movement therewith and at a location above the lower guide rail, a front guide roller, means mounting said front guide roller on said cabinet at a location adjacent to the front thereof for cooperation with one of said guide rails, a rear guide roller, and means mounting said rear guide roller on said shelf adjacent to the back thereof for cooperation with the other of said guide rails, whereby said rollers and said rails support said shelf for movement from a fully housed home position in said cabinet to a position out of said cabinet.

13. In a merchandising machine having a cabinet and a shelf, apparatus for supporting said shelf in said cabinet including in combination, an upper guide rail supported by one of said shelf and said cabinet, a lower guide rail supported by the other of said shelf and said cabinet, a rear guide roller, means mounting said rear guide roller on said shelf adjacent the rear thereof at a location at which it cooperates with one of said rails, a front guide roller, and means mounting said front guide roller on said cabinet adjacent to the front thereof for cooperation with the other of said guide rails.

14. In a merchandising machine having a cabinet and a shelf, apparatus for supporting said shelf for movement into and out of a home position at which said shelf is fully housed including in combination a rail having a top wall, means mounting said guide on said shelf with the length thereof extending generally from front to back of said cabinet, a roller, means mounting said roller on said cabinet adjacent to the front thereof at a location at which it receives said top wall to support said shelf for movement into and out of said home position, said top wall being formed with an upwardly offset portion at the front thereof and with a portion connecting said offset portion to the remainder of said wall, said portions cooperating with said roller to ensure that said shelf moves fully into its home position as it approaches said position.

* * * * *